US011646533B2

(12) United States Patent
Wu et al.

(10) Patent No.: US 11,646,533 B2
(45) Date of Patent: May 9, 2023

(54) ELECTRICAL CONNECTOR, ELECTRICAL CONNECTOR ASSEMBLY AND ELECTRICAL CONNECTOR MODULE

(71) Applicant: Dongguan Luxshare Technologies Co., Ltd, Dongguan (CN)

(72) Inventors: Shengyu Wu, Dongguan (CN); Chuanqi Gong, Dongguan (CN); Hongji Chen, Dongguan (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 187 days.

(21) Appl. No.: 17/201,675

(22) Filed: Mar. 15, 2021

(65) Prior Publication Data

US 2021/0296826 A1 Sep. 23, 2021

(30) Foreign Application Priority Data

Mar. 18, 2020 (CN) ..... 202010194117.3

(51) Int. Cl.

| | |
|---|---|
| ***H01R 4/66*** | (2006.01) |
| ***H01R 13/6471*** | (2011.01) |
| ***H01R 12/71*** | (2011.01) |
| ***H01R 13/405*** | (2006.01) |
| ***H01R 13/6585*** | (2011.01) |
| ***H01R 24/60*** | (2011.01) |
| *H01R 13/6582* | (2011.01) |

(52) U.S. Cl.

CPC ..... *H01R 13/6471* (2013.01); *H01R 12/716* (2013.01); *H01R 13/405* (2013.01); *H01R 13/6585* (2013.01); *H01R 24/60* (2013.01); *H01R 13/6582* (2013.01)

(58) Field of Classification Search

CPC ..... H01R 12/712; H01R 12/716; H01R 13/6471; H01R 13/405; H01R 13/6585; H01R 13/6582; H01R 24/60

USPC ..... 439/92–108

See application file for complete search history.

(56) References Cited

U.S. PATENT DOCUMENTS

| | | | |
|---|---|---|---|
| 6,421,912 | B1 | 7/2002 | Tomioka et al. |
| 9,711,907 | B2 | 7/2017 | Tamai |
| 9,716,326 | B2 | 7/2017 | Tamai |
| 2010/0183141 | A1 | 7/2010 | Arai et al. |
| 2010/0184307 | A1 | 7/2010 | Arai et al. |
| 2012/0202386 | A1 † | 8/2012 | McNamara et al. |

(Continued)

*Primary Examiner* — Khiem M Nguyen

(74) *Attorney, Agent, or Firm* — Birch, Stewart, Kolasch & Birch, LLP

(57) ABSTRACT

An electrical connector includes an insulating body and a first terminal module. The first terminal module includes a first insulating portion and a number of first terminals. The first terminals include a number of pairs of first signal terminals and a number of first ground terminals. The first insulating portion has a first side surface and a second side surface. The electrical connector includes a first metal shield mounted to the second side surface. The first metal shield is located between the second side surface and the insulating body. The first metal shield is in contact with the first ground terminals. The present disclosure increases the shielding area and improves the quality of signal transmission. The present disclosure also relates to an electrical connector assembly and an electrical connector module including the above-mentioned electrical connector.

20 Claims, 15 Drawing Sheets

(56) References Cited

U.S. PATENT DOCUMENTS

| | | | |
|---|---|---|---|
| 2015/0079814 | A1† | 3/2015 | Tamai |
| 2015/0079819 | A1 | 3/2015 | Tamai |
| 2016/0172780 | A1† | 6/2016 | Tamai |
| 2016/0172803 | A1 | 6/2016 | Tamai |
| 2016/0240976 | A1 | 8/2016 | Tamai |
| 2017/0346247 | A1 | 11/2017 | Tamai |
| 2017/0358885 | A1 | 12/2017 | Okuyama et al. |
| 2018/0013240 | A1 | 1/2018 | Takeuchi |
| 2018/0198220 | A1† | 7/2018 | Sasame et al. |
| 2019/0165509 | A1 | 5/2019 | Sano |
| 2019/0165515 | A1 | 5/2019 | Sano |

† cited by third party

ELECTRICAL CONNECTOR, ELECTRICAL CONNECTOR ASSEMBLY AND ELECTRICAL CONNECTOR MODULE

CROSS-REFERENCE TO RELATED APPLICATION

This patent application claims priority of a Chinese Patent Application No. 202010194117.3, filed on Mar. 18, 2020 and titled "ELECTRICAL CONNECTOR, ELECTRICAL CONNECTOR ASSEMBLY AND ELECTRICAL CONNECTOR MODULE", the entire content of which is incorporated herein by reference.

TECHNICAL FIELD

The present disclosure relates to an electrical connector, an electrical connector assembly and an electrical connector module, which belongs to a technical field of electrical connectors.

BACKGROUND

With continuous development of interconnection technologies, it puts forward higher requirements on the quality of signal transmission. The existing electrical connectors usually include a plurality of signal terminals and a plurality of ground terminals which are located on both sides of each group of signal terminals. However, how to better improve the quality of signal transmission to meet the requirements of high-speed signal transmission is a technical problem to be solved by those skilled in the art.

SUMMARY

An object of the present disclosure is to provide an electrical connector, an electrical connector assembly and an electrical connector module which are capable of improving the quality of signal transmission.

In order to achieve the above object, the present disclosure adopts the following technical solution: an electrical connector, comprising: an insulating body defining a first receiving space; a first terminal module received to the first receiving space of the insulating body, the first terminal module comprising a first insulating portion and a plurality of first terminals fixed to the first insulating portion, the plurality of first terminals comprising a plurality of pairs of first signal terminals and a plurality of first ground terminals, the first insulating portion having a first side surface and a second side surface opposite to the first side surface, the plurality of first terminals comprising a plurality of first contact portions exposed on the first side surface; and a first metal shield mounted to the second side surface and fixed with the first terminal module, wherein the first metal shield is located between the second side surface and the insulating portion, and the first metal shield is in contact with the plurality of first ground terminals.

In order to achieve the above object, the present disclosure adopts the following technical solution: an electrical connector assembly, comprising: a first electrical connector; a second electrical connector; and an adapter connector connecting the first electrical connector and the second electrical connector; each of the first electrical connector and the second electrical connector comprising: an insulating body defining a first receiving space; a first terminal module received to the first receiving space of the insulating body; the first terminal module comprising a first insulating portion and a plurality of first terminals fixed to the first insulating portion, the plurality of first terminals comprising a plurality of pairs of first signal terminals and a plurality of first ground terminals, the first insulating portion being provided with a first side surface and a second side surface opposite to the first side surface, the plurality of first terminals comprising a plurality of first contact portions exposed on the first side surface; and a first metal shield mounted to the second side surface and fixed with the first terminal module, wherein the first metal shield is located between the second side surface and the insulating portion, and the first metal shield is in contact with the plurality of first ground terminals; wherein the adapter connector comprises a first connecting portion and a second connecting portion opposite to the first connecting portion, the first terminal module of the first electrical connector is connected to the first connecting portion, and the first terminal module of the second electrical connector is connected to the second connecting portion.

In order to achieve the above object, the present disclosure adopts the following technical solution: an electrical connector module, comprising: a plurality of electrical connectors; and a bracket to support the plurality of electrical connectors; each electrical connector comprising: an insulating body defining a first receiving space; a first terminal module received to the first receiving space of the insulating body; the first terminal module comprising a first insulating portion and a plurality of first terminals fixed to the first insulating portion, the plurality of first terminals comprising a plurality of pairs of first signal terminals and a plurality of first ground terminals, the first insulating portion being provided with a first side surface and a second side surface opposite to the first side surface, the plurality of first terminals comprising a plurality of first contact portions exposed on the first side surface; and a first metal shield mounted to the second side surface and fixed with the first terminal module, wherein the first metal shield is located between the second side surface and the insulating portion, and the first metal shield is in contact with the plurality of first ground terminals; wherein the bracket and the plurality of electrical connectors are connected as a whole.

Compared with the prior art, the electrical connector of the present disclosure includes the first metal shield mounted on the second side surface and fixed with the first terminal module, the first metal shield is located between the second side surface and the insulating body, and the first metal shield is in contact with the plurality of first ground terminals, thereby increasing the shielding area and improving the quality of signal transmission.

DETAILED DESCRIPTION

Figure 1:
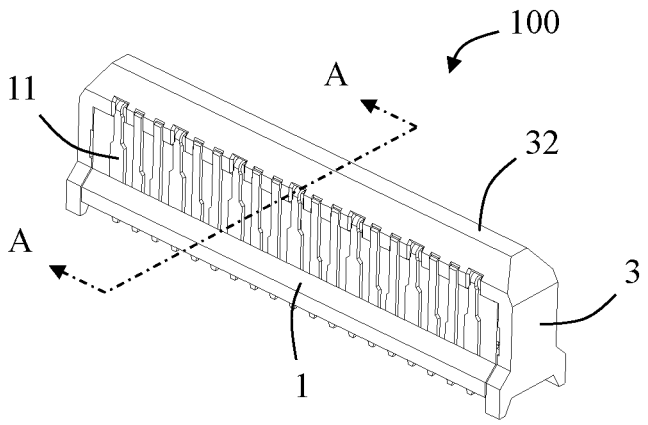
FIG. 1 is a perspective view of a first electrical connector in accordance with an embodiment of the present disclosure.
Figure 2:
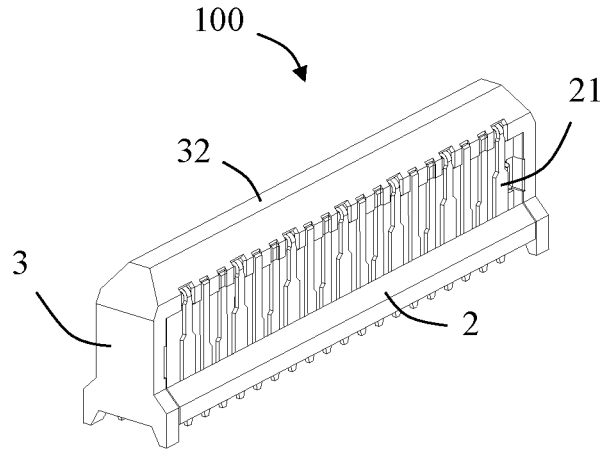
FIG. 2 is a perspective schematic view of FIG. 1 from another angle.

Exemplary embodiments will be described in detail here, examples of which are shown in drawings. When referring to the drawings below, unless otherwise indicated, same numerals in different drawings represent the same or similar elements. The examples described in the following exemplary embodiments do not represent all embodiments consistent with this application. Rather, they are merely examples of devices and methods consistent with some aspects of the application as detailed in the appended claims.

The terminology used in this application is only for the purpose of describing particular embodiments, and is not intended to limit this application. The singular forms "a", "said", and "the" used in this application and the appended claims are also intended to include plural forms unless the context clearly indicates other meanings.

It should be understood that the terms "first", "second" and similar words used in the specification and claims of this application do not represent any order, quantity or importance, but are only used to distinguish different components. Similarly, "an" or "a" and other similar words do not mean a quantity limit, but mean that there is at least one; "multiple" or "a plurality of" means two or more than two. Unless otherwise noted, "front", "rear", "lower" and/or "upper" and similar words are for ease of description only and are not limited to one location or one spatial orientation. Similar words such as "include" or "comprise" mean that elements or objects appear before "include" or "comprise" cover elements or objects listed after "include" or "comprise" and their equivalents, and do not exclude other elements or objects. The term "a plurality of" mentioned in the present disclosure includes two or more.

Hereinafter, some embodiments of the present disclosure will be described in detail with reference to the accompanying drawings. In the case of no conflict, the following embodiments and features in the embodiments can be combined with each other.

Referring to FIGS. 1 to 8, an illustrated embodiment of the present disclosure discloses a first electrical connector 100 which includes an insulating body 3, a first terminal module 1 mounted to the insulating body 3, a first metal shield 4 fixed with the first terminal module 1, a second terminal module 2 mounted to the insulating body 3, and a second metal shield 5 fixed together with the second terminal module 2.

Figure 3:
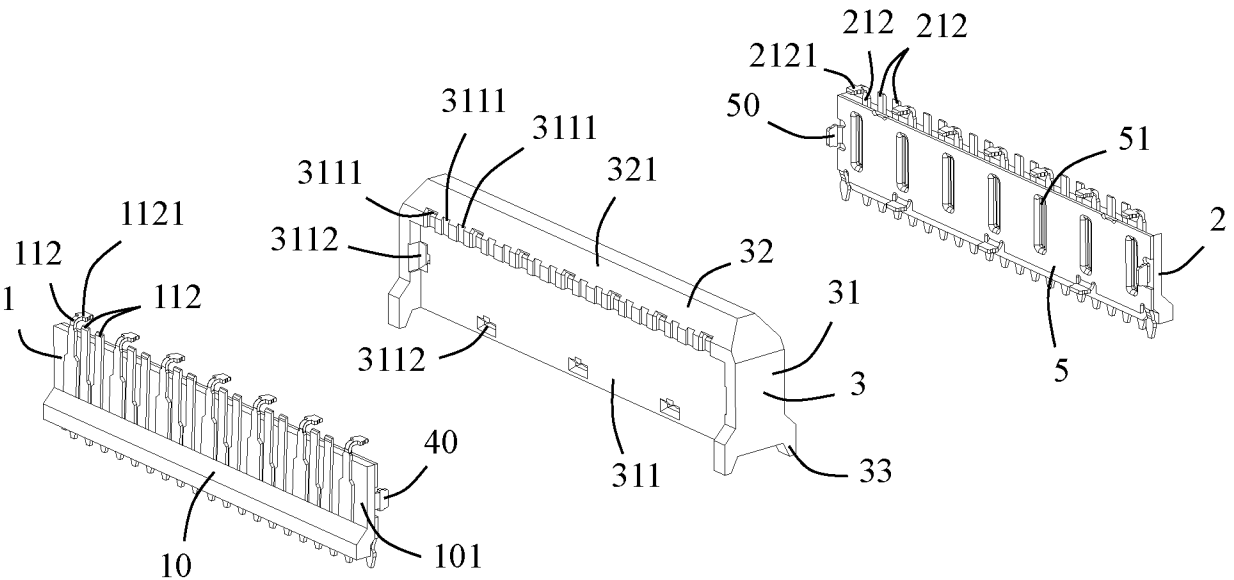
FIG. 3 is a partially exploded perspective view of FIG. 1.
Figure 4:
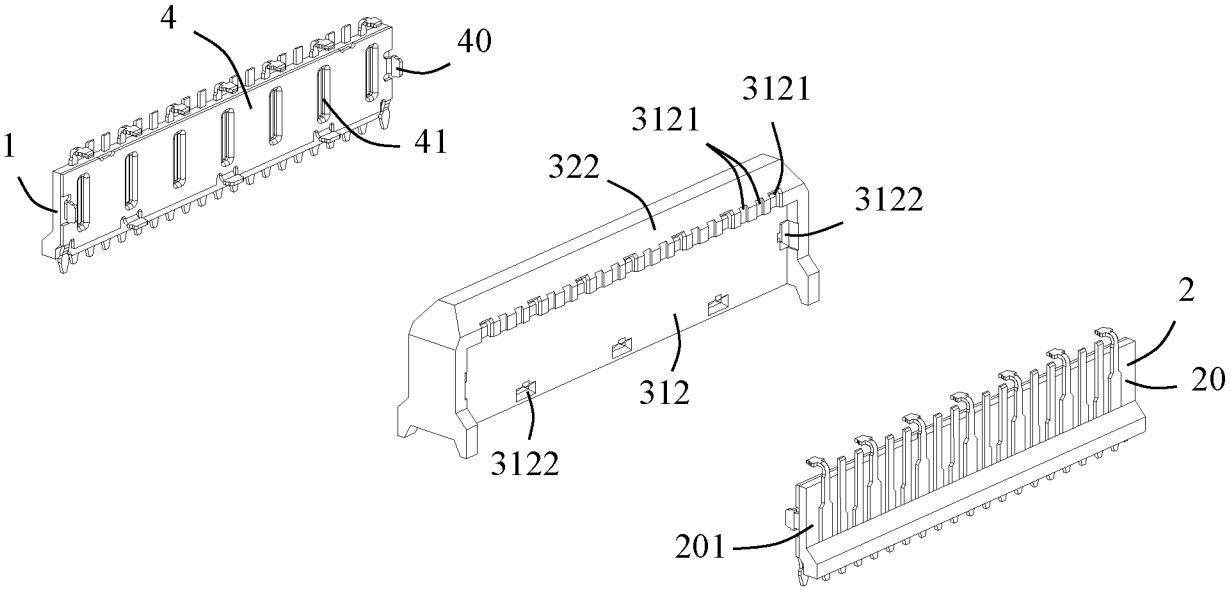
FIG. 4 is a partially exploded perspective view of FIG. 2.

Referring to FIGS. 3 and 4, the insulating body 3 includes a main body portion 31, a guiding portion 32 extending from one end of the main body portion 31, and a mounting portion 33 extending from the other end of the main body portion 31. The main body portion 31 defines a first receiving space 311 for receiving the first terminal module 1 and a second receiving space 312 for receiving the second terminal module 2. The first receiving space 311 and the second receiving space 312 are respectively located on two opposite sides of the main body 31. The insulating body 3 also defines a plurality of first positioning grooves 3111 communicating with the first receiving space 311, a plurality of first slots 3112 for fixing the first metal shield 4, a plurality of second positioning grooves 3121 communicating with the second receiving space 312, and a plurality of second slots 3122 for fixing the second metal shield 5. The guiding portion 32 is contracted compared to the main body portion 31. The guiding portion 32 has a first inclined surface 321 and a second inclined surface 322. The first positioning grooves 3111 extend upwardly through part of the first inclined surface 321, and the second positioning grooves 3121 extend upwardly through part of the second inclined surface 322.

Figure 5:
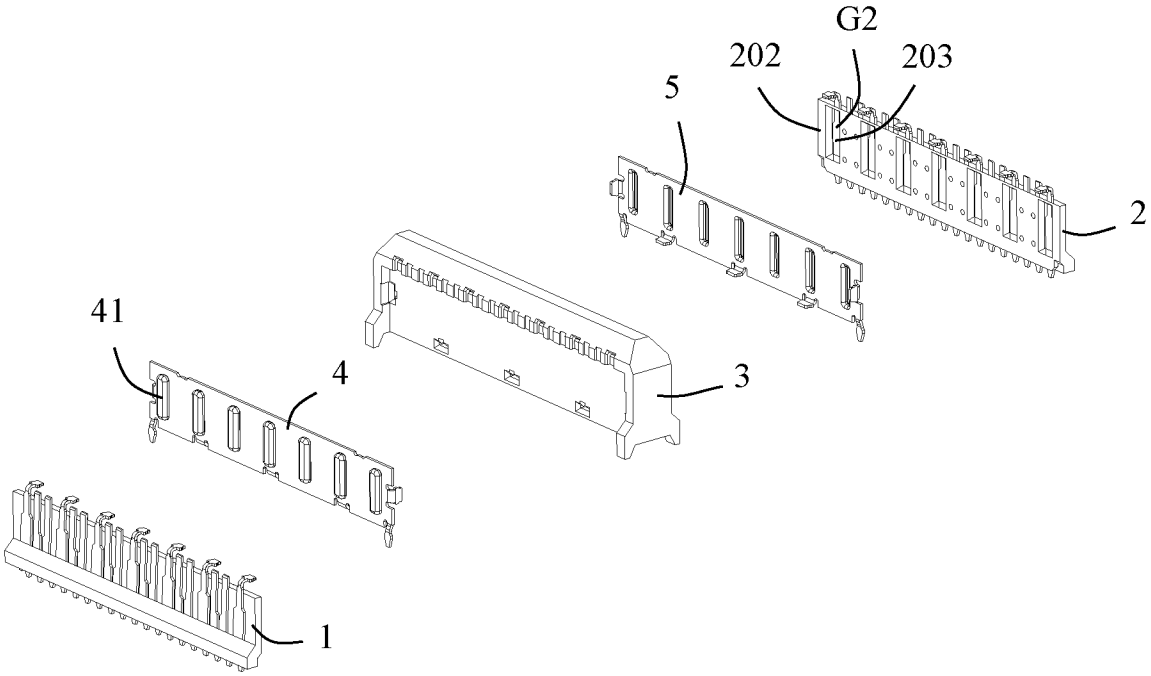
FIG. 5 is a further perspective exploded view of FIG. 3.
Figure 6:
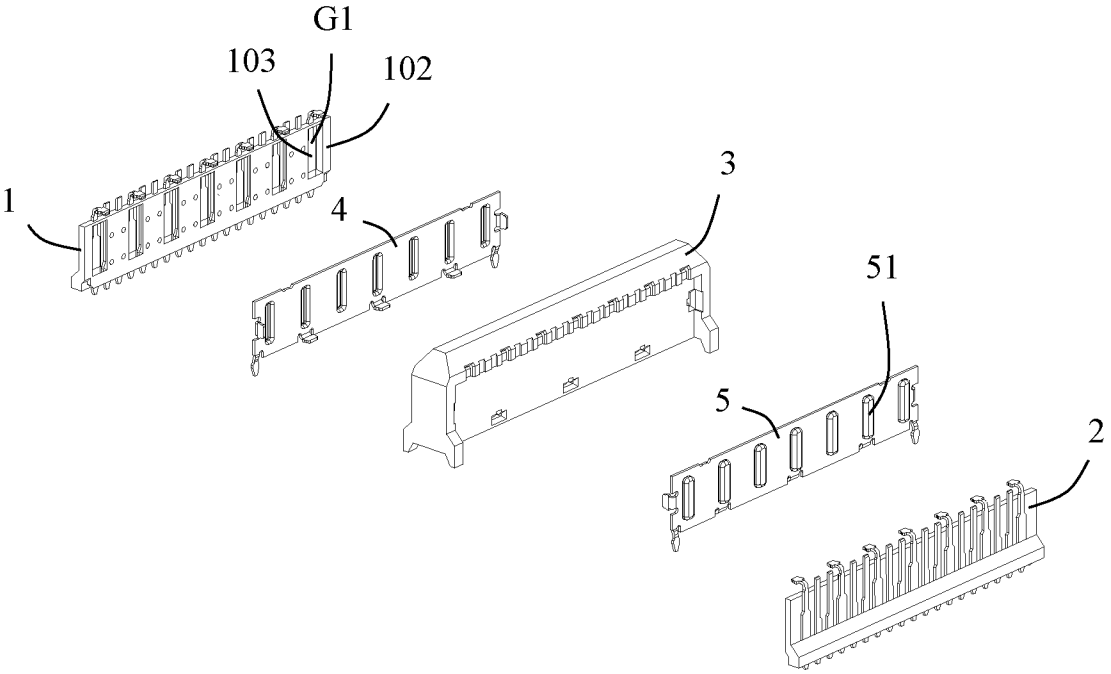
FIG. 6 is a further perspective exploded view of FIG. 4.
Figure 7:
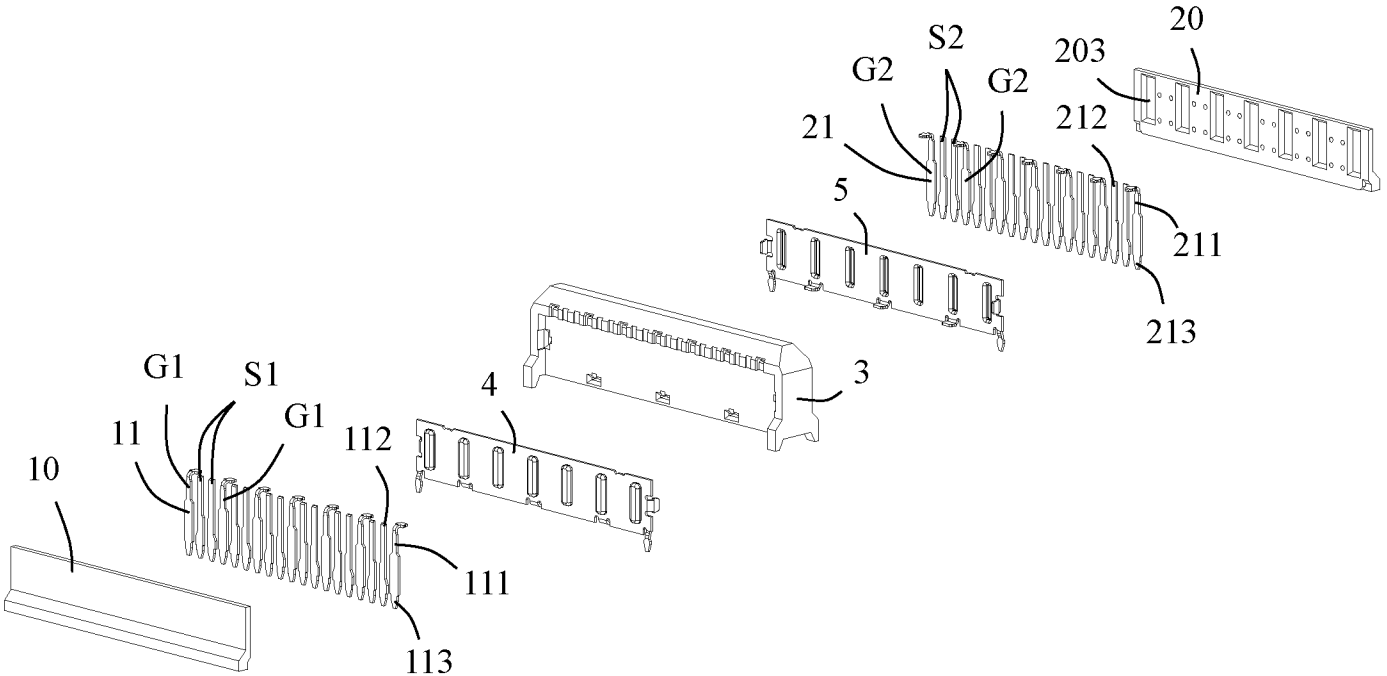
FIG. 7 is a further perspective exploded view of FIG. 5.
Figure 8:
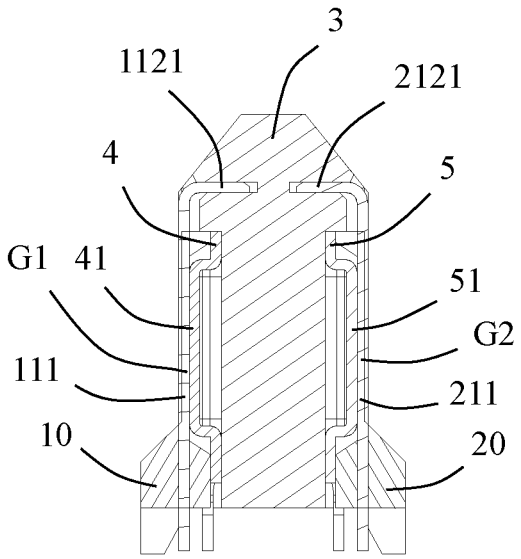
FIG. 8 is a schematic cross-sectional view taken along line A-A in FIG. 1.

Referring to FIGS. 3 to 7, the first terminal module 1 includes a first insulating portion 10 and a plurality of first terminals 11 fixed to the first insulating portion 10. Referring to FIG. 7, the plurality of first terminals 11 include a plurality of pairs of first signal terminals S1 and a plurality of first ground terminals G1. Each pair of first signal terminals S1 are associated with two first ground terminals G1 between which the pair of first signal terminals S1 are located, in order to improve the quality of signal transmission. The first insulating portion 10 has a first side surface 101 (referring to FIG. 3) and a second side surface 102 (referring to FIG. 6) opposite to the first side surface 101. The first terminal 11 has a first contact portion 111 exposed on the first side surface 101, a first positioning portion 112 extending upwardly beyond the first insulating portion 10, and a first mounting portion 113 extending downwardly beyond the first insulating portion 10. In the illustrated embodiment of the present disclosure, the first positioning portion 112 of the first signal terminal S1 is aligned with the first contact portion 111 of the same first signal terminal S1. The first positioning portion 112 of the first ground terminal G1 is of a substantial L-shaped configuration and includes a first bent portion 1121 at the top end. The first bent portion 1121 is perpendicular to the first contact portion 111 of the first ground terminal G1. In some embodiments, the first positioning portion 112 of the first ground terminal G1 is aligned with the first contact portion 111 of the same first ground terminal G1. Alternatively, the first positioning portion 112 of the first ground terminal G1 may not have the first bent portion 1121, but is of a straight strip shape configuration together with the first contact portion 111. In an embodiment of the present disclosure, the first terminals 11 are insert-molded with the first insulating portion 10 for fixation.

The first metal shield 4 is mounted to the second side surface 102 of the first insulating portion 10 and fixed with the first terminal module 1. The first metal shield 4 is located between the second side surface 102 and the insulating body 3, and the first metal shield 4 is in contact with the plurality of first ground terminals G1, thereby increasing the grounding area and improving the shielding effect. In an embodiment of the present disclosure, the first terminal module 1 and the first metal shield 4 are fixed together by heat melting, soldering, or welding.

In the illustrated embodiment of the present disclosure, the first insulating portion 10 defines a plurality of first grooves 103 on the second side surface 102 (referring to FIG. 6). The plurality of first ground terminals G1 are respectively exposed in the first grooves 103. The first metal shield 4 is provided with a plurality of first protrusions 41 protruding toward the corresponding first grooves 103. The first protrusions 41 are connected to the corresponding first ground terminals G1. In an embodiment of the present disclosure, the plurality of first protrusions 41 and the corresponding first ground terminals G1 are fixedly connected by solder, conductive glue or conductive films. The first metal shield 4 further includes a plurality of first protrusion portions 40 fixed in the first slots 3112 (referring to FIGS. 3 and 4).

Referring to FIGS. 3 to 7, the second terminal module 2 includes a second insulating portion 20 and a plurality of second terminals 21 fixed to the second insulating portion 20. Referring to FIG. 7, the plurality of second terminals 21 include a plurality of pairs of second signal terminals S2 and a plurality of second ground terminals G2. Each pair of second signal terminals S2 are associated with two second ground terminals G2 between which the pair of second signal terminals S2 are located, in order to improve the quality of signal transmission. The second insulating portion 20 has a third side surface 201 (referring to FIG. 4) and a fourth side surface 202 (referring to FIG. 5) opposite to the third side surface 201. The second terminal 21 has a second contact portion 211 exposed on the third side surface 201, a second positioning portion 212 extending upwardly beyond the second insulating portion 20, and a second mounting portion 213 extending downwardly beyond the second insulating portion 20. In the illustrated embodiment of the present disclosure, the second positioning portion 212 of the second signal terminal S2 is aligned with the second contact portion 211 of the same second signal terminal S2. The second positioning portion 212 of the second ground terminal G2 is of a substantial L-shaped configuration, and includes a second bent portion 2121 at the top end. The second bent portion 2121 is perpendicular to the second contact portion 211 of the second ground terminal G2. In some embodiments, the second positioning portion 212 of the second ground terminal G2 is aligned with the second contact portion 211 of the same second ground terminal G2. The second positioning portion 212 of the second ground terminal G2 may not have the second bent portion 2121, but is of a straight strip shape configuration together with the second contact portion 211. In an embodiment of the present disclosure, the second terminals 21 are insert-molded with the second insulating portion 20 for fixation.

The second metal shield 5 is mounted to the fourth side surface 202 of the second insulating portion 20 and fixed with the second terminal module 2. The second metal shield 5 is located between the fourth side surface 202 and the insulating body 3, and the second metal shield 5 is in contact with the plurality of second ground terminals G2, thereby increasing the grounding area and improving the shielding effect. In an embodiment of the present disclosure, the second terminal module 2 and the second metal shield 5 are fixed together by heat melting, soldering, or welding.

In the illustrated embodiment of the present disclosure, the second insulating portion 20 defines a plurality of third grooves 203 on the fourth side surface 202 (referring to FIG. 5). The plurality of second ground terminals G2 are respectively exposed in the third grooves 203. The second metal shield 5 includes a plurality of second protrusions 51 protruding toward the corresponding third grooves 203. The plurality of second protrusions 51 are connected to the corresponding second ground terminals G2. In an embodiment of the present disclosure, the plurality of second protrusions 51 and the corresponding second ground terminals G2 are fixedly connected by solder, conductive glue or conductive films. The second metal shield 5 further includes a plurality of second protrusion portions 50 fixed in the second slots 3122 (referring to FIGS. 3 and 5).

Referring to FIGS. 9 to 12, the present disclosure discloses a second electrical connector 200 which has most of the same features as the first connector 100. The main differences between the first connector 100 and the second connector 200 include, in the first connector 100, the plurality of pairs of first signal terminals S1 and the plurality of pairs of second signal terminals S2 are all non-intersecting structures. That is, between each pair of first signal terminals S1 There is no overlap in the direction perpendicular to the first and second side surfaces 101 and 102 of the first insulating portion 10 (that is, a thickness direction of the first insulating portion 10). There is no overlap between each pair of second signal terminals S2 in a direction perpendicular to the third and fourth side surfaces 201, 202 of the second insulating portion 20 (that is, a thickness direction of the second insulating portion 20). Each pair of first signal terminals S1 and each pair of second signal terminals S2 of the first connector 100 are straight. However, in the second electrical connector 200, the plurality of pairs of first signal terminals S1 include at least one pair of the first signal terminals S1 which intersect each other. The plurality of pairs of second signal terminals S2 include at least one pair of the second signal terminals S2 which intersect each other. The at least one pair of first signal terminals S1, which intersect each other, jointly form a first intersecting structure X1. The at least one pair of second signal terminals S2, which intersect each other, jointly form a second intersecting structure X2. In this embodiment, in the second electrical connector 200, the plurality of pairs of first signal terminals S1 include a plurality of pairs of the first signal terminals S1 which intersect each other. Besides, a pair of first signal terminals S1 which do not intersect each other are provided between two adjacent pairs of the first signal terminals S1 which intersect each other. The plurality of pairs of second signal terminals S2 include a plurality of pairs of the second signal terminals S2 which intersect each other. Besides, a pair of second signal terminals S2 which do not intersect each other are provided between two adjacent pairs of the second signal terminals S2 which intersect each other.

Figure 9:
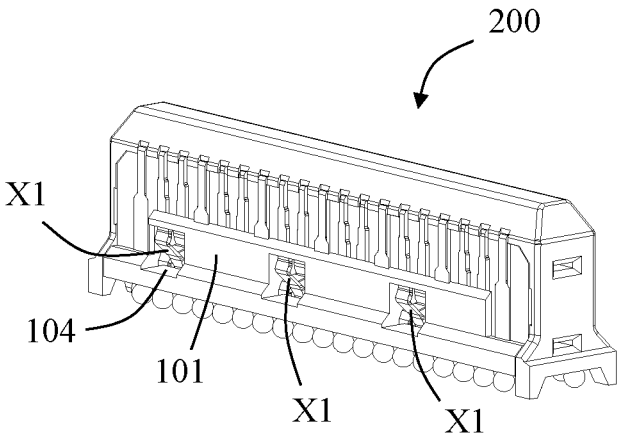
FIG. 9 is a perspective view of a second electrical connector in accordance with an embodiment of the present disclosure.
Figure 10:
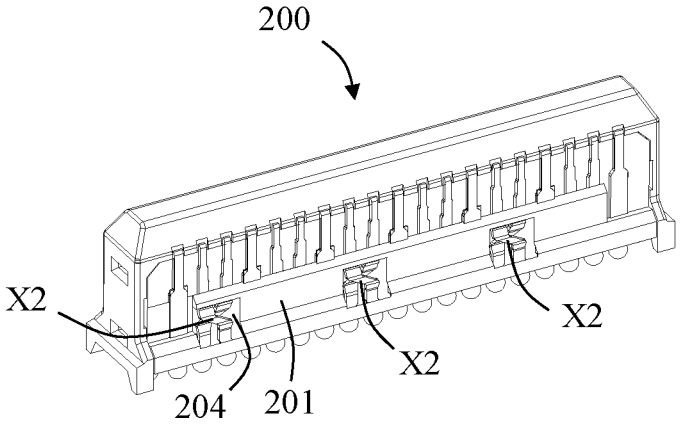
FIG. 10 is a perspective schematic view of FIG. 9 from another angle.
Figure 11:
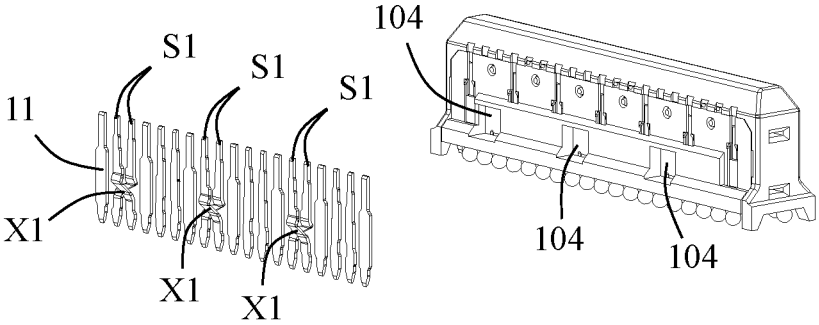
FIG. 11 is a partially exploded perspective view of FIG. 9 with the first terminals separated.
Figure 12:
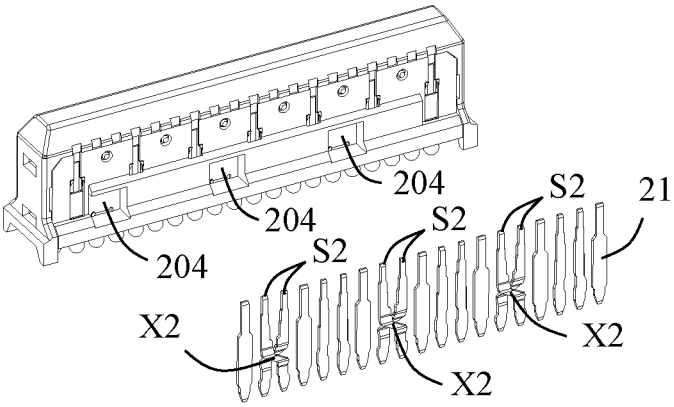
FIG. 12 is a partially exploded perspective view of FIG. 10 with the second terminals separated.
Figure 13:
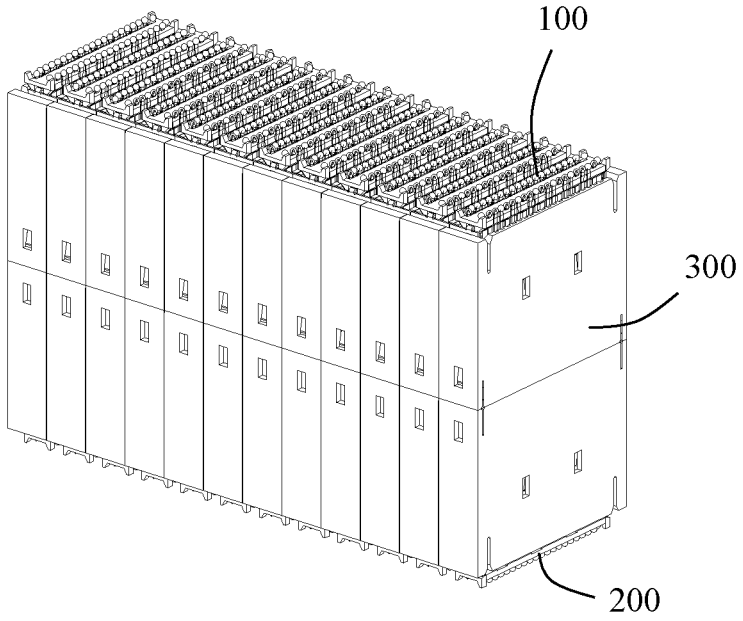
FIG. 13 is a perspective view of an electrical connector assembly in accordance with an embodiment of the present disclosure.

Referring to FIG. 9, in the second electrical connector 200, the first insulating portion 10 includes at least one second groove 104 on the first side surface 101. The first intersecting structure X1 is exposed in the second groove 104, so that the first intersecting structure X1 is exposed to the air. Referring to FIG. 10, the second insulating portion 20 has at least one fourth groove 204 on the third side surface 201. The second intersecting structure X2 is exposed in the fourth groove 204, so that the second intersecting structure X2 is exposed to the air. In the illustrated embodiment of the present disclosure, the first intersecting structure X1 overlaps but does not contact with each other in the direction perpendicular to the first and second side surfaces 101 and 102 of the first insulating portion 10 (that is, the thickness direction of the first insulating portion 10). The second intersecting structure X2 overlaps but does not contact with each other in the direction perpendicular to the third and fourth side surfaces 201 and 202 of the second insulating portion 20 (that is, the thickness direction of the second insulating portion 20).

By providing the second groove 104 and the fourth groove 204, the first intersecting structure X1 and the second intersecting structure X2 are exposed to the air, which is beneficial to the positioning of plastic molds on the one hand, and is beneficial to improve the Signal Integrity (SI), such as improving signal delay and adjusting impedance on the other hand. In other words, if the first intersecting structure X1 and the second intersecting structure X2 are enclosed in the insulating portion, the straight signal terminals beside them will form a large delay difference compared with the intersecting signal terminals, which is not beneficial to improve the quality of signal transmission.

Figure 14:
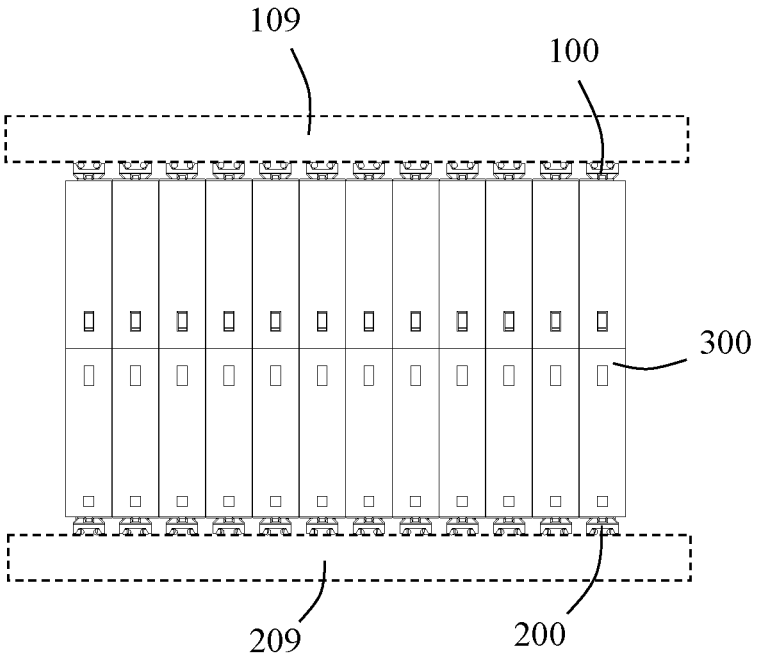
FIG. 14 is a front view of FIG. 13 and schematically shows how it is mounted to a circuit board.
Figure 15:
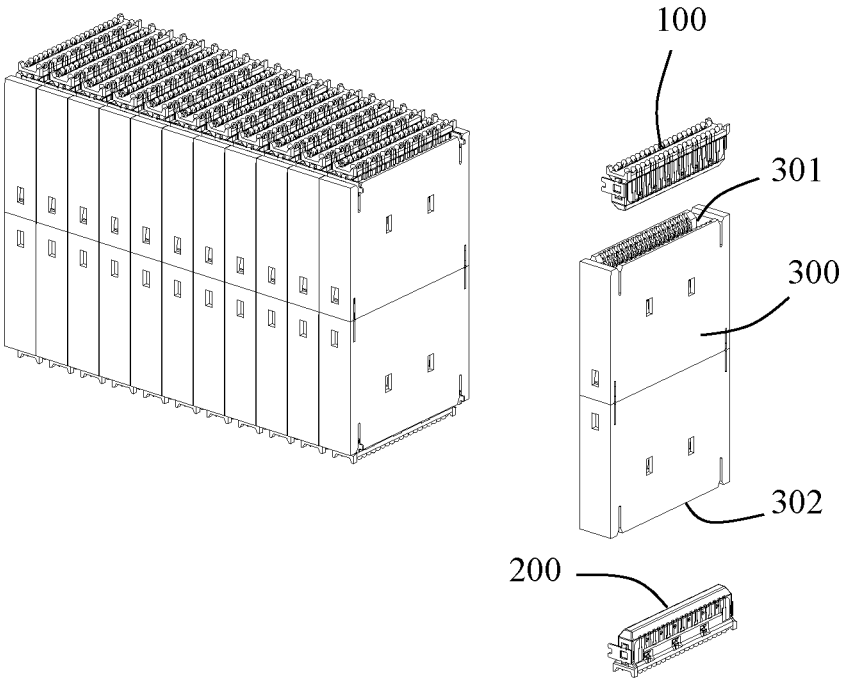
FIG. 15 is a partially exploded perspective view of FIG. 14.

Referring to FIGS. 13 to 16, the present disclosure also discloses an electrical connector assembly which includes the first electrical connector 100, the second electrical connector 200, and an adapter connector 300 connecting the first electrical connector 100 and the second electrical connector 200. The adapter connector 300 includes a first connecting portion 301 and a second connecting portion 302 opposite to the first connecting portion 301. The first terminal module 1 and the second terminal module 2 of the first electrical connector 100 are connected to the first connecting portion 301. The first terminal module 1 and the second terminal module 2 of the second electrical connector 200 are connected to the second connecting portion 302. Referring to FIG. 14, the first electrical connector 100 is adapted for being mounted to a first circuit board 109. The second electrical connector 200 is adapted for being mounted to a second circuit board 209. In an embodiment of the present disclosure, the first circuit board 109 is parallel to the second circuit board 209.

Figure 16:
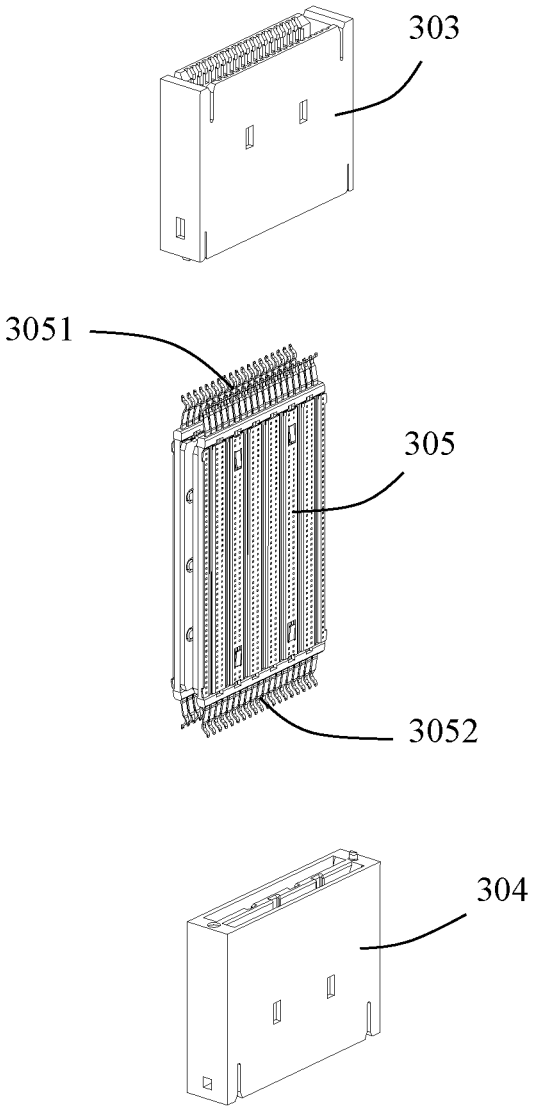
FIG. 16 is a partially exploded perspective view of an adapter connector in FIG. 15.

Referring to FIG. 16, the adapter connector 300 includes a first adapter housing 303, a second adapter housing 304 and a terminal assembly 305. The first adapter housing 303 and the second adapter housing 304 are assembled with each other. The terminal assembly 305 is received in the first adapter housing 303 and the second adapter housing 304. The terminal assembly 305 includes a first terminal clamping portion 3051 located in the first connecting portion 301 and a second terminal clamping portion 3052 located in the second connecting portion 302. The first terminal clamping portion 3051 is used to contact the first terminals 11 and the second terminals 21 of the first electrical connector 100. The second terminal clamping portion 3052 is used for contacting the first terminals 11 and the second terminals 21 of the second electrical connector 200.

Figure 17:
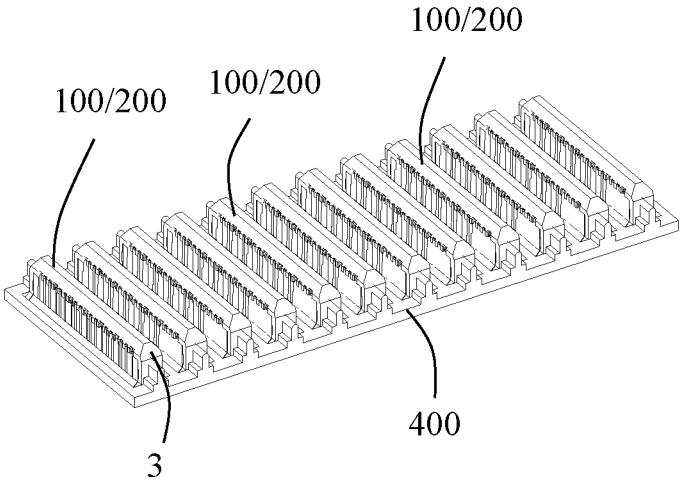
FIG. 17 is a perspective schematic view of an electrical connector module in accordance with an embodiment of the present disclosure.
Figure 18:
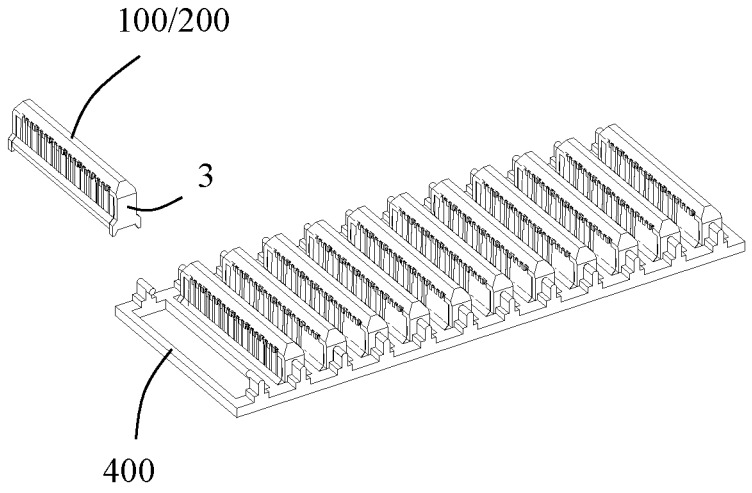
FIG. 18 is a partially exploded perspective view of FIG. 17.

Referring to FIGS. 17 and 18, the present disclosure also discloses an electrical connector module which includes a plurality of electrical connectors and a bracket 400 to support the plurality of electrical connectors. The bracket 400 is connected to the plurality of electrical connectors as a whole, so that the electrical connector module has a strong signal transmission capability. The plurality of electrical connectors are arranged parallel to each other and side by side. The insulating bodies of the electrical connectors are inserted-molded with the bracket 400 for fixation. In the specific embodiment of the present disclosure, the plurality of electrical connectors are the plurality of first electrical connectors 100 and/or the plurality of second electrical connectors 200. The electrical connector is a general concept of the first electrical connector 100 and the second electrical connector 200.

Compared with the prior art, the electrical connector of the present disclosure is provided with a metal shield mounted to the side surface of the insulating portion and fixed with the terminal module. The metal shield is located between the insulating portion and the insulating body. The ground terminals are in contact with the metal shield. This arrangement increases the shielding area and improves the quality of signal transmission. In addition, the signal terminals of the electrical connector of the present disclosure are provided with a intersecting structure, which is capable of improving the signal transmission rate and reducing the effects of cross-talk and resonance.

The above embodiments are only used to illustrate the present disclosure and not to limit the technical solutions described in the present disclosure. The understanding of this specification should be based on those skilled in the art. Descriptions of directions, such as "front" and "back", although they have been described in detail in the above-mentioned embodiments of the present disclosure, those skilled in the art should understand that modifications or equivalent substitutions can still be made to the application, and all technical solutions and improvements that do not depart from the spirit and scope of the application should be covered by the claims of the application.

What is claimed is:

1. An electrical connector, comprising:

an insulating body defining a first module receiving space opened to an outside along a first direction, the insulating body being configured to be connected to a connecting portion of a mating connector along a second direction perpendicular to the first direction;

a first terminal module assembled to the first module receiving space of the insulating body along the first direction, the first terminal module comprising a first insulating portion received in the first module receiving space and a plurality of first terminals fixed to the first insulating portion, the plurality of first terminals comprising a plurality of pairs of first signal terminals and a plurality of first ground terminals, the first insulating portion having a first side surface and a second side surface opposite to the first side surface, the plurality of first terminals comprising a plurality of first contact portions exposed on the first side surface; and a first metal shield assembled to the second side surface and fixed with the first terminal module to be a first module as a whole, wherein the first module is assembled to the first module receiving space along the first direction, the first metal shield is located between the second side surface and the insulating portion in the first direction, and the first metal shield is in contact with the plurality of first ground terminals.

2. The electrical connector according to claim 1, wherein the first insulating portion comprises a plurality of first grooves on the second side surface, the plurality of first ground terminals are respectively exposed in the first grooves, the first metal shield comprises a plurality of first protrusions extending along the second direction, and the plurality of first protrusions are received in the first grooves to be in contact with the corresponding first ground terminals.

3. The electrical connector according to claim 2, wherein the plurality of first protrusions are first ribs which are formed by stamping the first metal shield; and the plurality of first protrusions and the corresponding first ground terminals are fixed with each other through solder, conductive glue or conductive films.

4. The electrical connector according to claim 1, wherein the plurality of pairs of first signal terminals comprise at least one pair of first signal terminals which intersect each other, and the at least one pair of first signal terminals jointly form a first intersecting structure.

5. The electrical connector according to claim 4, wherein the first insulating portion comprises at least one second groove on the first side surface, and the first intersecting structure is exposed in the at least one second groove.

6. The electrical connector according to claim 1, further comprising:

a second terminal module assembled to the insulating body along the first direction, wherein the insulating body defines a second module receiving space for receiving the second terminal module, the first module receiving space and the second module receiving space are respectively located on two opposite sides of the insulating body, the second terminal module comprises a second insulating portion received in the second module receiving space and a plurality of second terminals fixed to the second insulating portion, the plurality of second terminals comprise a plurality of pairs of second signal terminals and a plurality of second ground terminals, the second insulating portion has a third side surface and a fourth side surface opposite to the third side surface, the plurality of second terminals comprise a plurality of second contact portions exposed on the third side surface; and a second metal shield assembled to the fourth side surface and fixed with the second terminal module to be a second module as a whole, wherein the second module is assembled to the second module receiving space along the first direction, the second metal shield is located between the fourth side surface and the insulating body in the first direction, and the second metal shield is in contact with the plurality of second ground terminals.

7. The electrical connector according to claim 1, wherein the first terminals are insert-molded with the first insulating portion.

8. The electrical connector according to claim 7, wherein the first terminal module and the first metal shield are fixed together through heat melting, soldering, or welding.

9. An electrical connector assembly, comprising:

a first electrical connector;

a second electrical connector; and an adapter connector connecting the first electrical connector and the second electrical connector;

each of the first electrical connector and the second electrical connector comprising:

an insulating body defining a first receiving space;

a first terminal module received to the first receiving space of the insulating body; the first terminal module comprising a first insulating portion and a plurality of first terminals fixed to the first insulating portion, the plurality of first terminals comprising a plurality of pairs of first signal terminals and a plurality of first ground terminals, the first insulating portion being provided with a first side surface and a second side surface opposite to the first side surface, the plurality of first terminals comprising a plurality of first contact portions exposed on the first side surface; and a first metal shield mounted to the second side surface and fixed with the first terminal module, wherein the first metal shield is located between the second side surface and the insulating portion, and the first metal shield is in contact with the plurality of first ground terminals;

wherein the adapter connector comprises a first connecting portion and a second connecting portion opposite to the first connecting portion, the first terminal module of the first electrical connector is connected to the first connecting portion, and the first terminal module of the second electrical connector is connected to the second connecting portion.

10. The electrical connector assembly according to claim 9, wherein the first insulating portion comprises a plurality of first grooves on the second side surface, the plurality of first ground terminals are respectively exposed in the first grooves, the first metal shield comprises a plurality of first protrusions protruding toward the corresponding first grooves, and the plurality of first protrusions are connected to the corresponding first ground terminals.

11. The electrical connector assembly according to claim 10, wherein the plurality of first protrusions and the corresponding first ground terminals are fixed with each other through solder, conductive glue or conductive films.

12. The electrical connector assembly according to claim 9, wherein the plurality of pairs of first signal terminals comprise at least one pair of first signal terminals which intersect each other, and the at least one pair of first signal terminals jointly form a first intersecting structure.

13. The electrical connector assembly according to claim 12, wherein the first insulating portion comprises at least one second groove on the first side surface, and the first intersecting structure is exposed in the at least one second groove.

14. The electrical connector assembly according to claim 9, wherein the plurality of pairs of first signal terminals of the first electrical connector are all non-intersecting structures, the plurality of pairs of first signal terminals of the second electrical connector comprise at least one pair of first signal terminals which intersect each other, and the at least one pair of first signal terminals jointly form a first intersecting structure.

15. The electrical connector assembly according to claim 9, wherein each of the first electrical connector and the second electrical connector comprises a second terminal module mounted to the insulating body, the insulating body defines a second receiving space for receiving the second terminal module, the first receiving space and the second receiving space are respectively located on two opposite sides of the insulating body, the second terminal module comprises a second insulating portion and a plurality of second terminals fixed to the second insulating portion, the plurality of second terminals comprise a plurality of pairs of second signal terminals and a plurality of second ground terminals, the second insulating portion has a third side surface and a fourth side surface opposite to the third side surface, the plurality of second terminals comprise a plurality of second contact portions exposed on the third side surface; and wherein each of the first electrical connector and the second electrical connector further comprises a second metal shield mounted to the fourth side surface and fixed with the second terminal module, the second metal shield is located between the fourth side surface and the insulating body, and the second metal shield is in contact with the plurality of second ground terminals.

16. An electrical connector module, comprising:

a plurality of electrical plug connectors; and a bracket to support the plurality of electrical plug connectors;

each electrical plug connector comprising:

an insulating body defining a first module receiving space opened to an outside along a first direction, the insulating body being configured to be connected to a connecting portion of a mating connector along a second direction perpendicular to the first direction;

a first terminal module assembled to the first module receiving space of the insulating body along the first direction; the first terminal module comprising a first insulating portion and a plurality of first terminals fixed to the first insulating portion received in the first module receiving space, the plurality of first terminals comprising a plurality of pairs of first signal terminals and a plurality of first ground terminals, the first insulating portion being provided with a first side surface and a second side surface opposite to the first side surface, the plurality of first terminals comprising a plurality of first contact portions exposed on the first side surface; and a first metal shield assembled to the second side surface and fixed with the first terminal module to be a first module as a whole, wherein the first module is assembled to the first module receiving space along the first direction, the first metal shield is located between the second side surface and the insulating portion in the first direction, and the first metal shield is in contact with the plurality of first ground terminals;

wherein the bracket and the plurality of electrical plug connectors are connected as a whole.

17. The electrical connector module of claim 16, wherein each electrical plug connector further comprises a second terminal module assembled to the insulating body along the first direction, wherein the insulating body defines a second module receiving space for receiving the second terminal module, the first module receiving space and the second module receiving space are respectively located on two opposite sides of the insulating body, the second terminal module comprises a second insulating portion received in the second module receiving space and a plurality of second terminals fixed to the second insulating portion, the plurality of second terminals comprise a plurality of pairs of second signal terminals and a plurality of second ground terminals, the second insulating portion has a third side surface and a fourth side surface opposite to the third side surface, the plurality of second terminals comprise a plurality of second contact portions exposed on the third side surface; and a second metal shield assembled to the fourth side surface and fixed with the second terminal module to be a second module as a whole, wherein the second module is assembled to the second module receiving space along the first direction, the second metal shield is located between the fourth side surface and the insulating body in the first direction, and the second metal shield is in contact with the plurality of second ground terminals.

18. The electrical connector module according to claim 16, wherein the insulating bodies of the plurality of electrical plug connectors are insert-molded with the bracket.

19. The electrical connector module according to claim 16, wherein the first insulating portion comprises a plurality of first grooves on the second side surface, the plurality of first ground terminals are respectively exposed in the first grooves, the first metal shield comprises a plurality of first ribs extending along the second direction, and the plurality of first ribs are received in the first grooves to be in contact with the corresponding first ground terminals.

20. The electrical connector module according to claim 19, wherein the plurality of first ribs and the corresponding first ground terminals are fixed with each other through solder, conductive glue or conductive films.

* * * * *